US008893929B2

(12) United States Patent
Geiberger

(10) Patent No.: US 8,893,929 B2
(45) Date of Patent: Nov. 25, 2014

(54) WALL-MOUNTED METERING DISPENSER

(75) Inventor: Christoph Geiberger, Konigswinter (DE)

(73) Assignee: ADA Cosmetic GmbH, Kehl/Baden (DE)

( * ) Notice: Subject to any disclaimer, the term of this patent is extended or adjusted under 35 U.S.C. 154(b) by 0 days.

(21) Appl. No.: 13/704,118

(22) PCT Filed: Mar. 2, 2011

(86) PCT No.: PCT/EP2011/001032

§ 371 (c)(1),
(2), (4) Date: Dec. 13, 2012

(87) PCT Pub. No.: WO2011/157308

PCT Pub. Date: Dec. 22, 2011

(65) Prior Publication Data

US 2013/0092708 A1 Apr. 18, 2013

(30) Foreign Application Priority Data

Jun. 17, 2010 (DE) ..... 20 2010 009 176 U

(51) Int. Cl.

| | |
|---|---|
| ***B67D 7/06*** | (2010.01) |
| ***A47K 5/122*** | (2006.01) |
| ***A47K 5/12*** | (2006.01) |

(52) U.S. Cl.

CPC ..... *A47K 5/1209* (2013.01); *A47K 5/122* (2013.01)

USPC ..... 222/181.3; 222/153.03

(58) Field of Classification Search

CPC .... A47K 5/1209; A47K 5/1208; A47K 5/122

USPC ..... 222/180.1, 180.2, 153.03, 153.09, 160, 222/162, 165

See application file for complete search history.

(56) References Cited

U.S. PATENT DOCUMENTS

| | | | | |
|---|---|---|---|---|
| 3,096,913 | A | 7/1963 | Corley | |
| 7,051,987 | B2 * | 5/2006 | Chen | 248/447.1 |
| 7,261,268 | B2 * | 8/2007 | Kunesh et al. | 248/310 |
| 7,654,417 | B2 * | 2/2010 | Rhodenbaugh et al. | 222/153.03 |
| 2005/0077385 | A1 | 4/2005 | Chen | |
| 2012/0199609 | A1 * | 8/2012 | Schwenkenberg | 222/181.3 |
| 2013/0092708 | A1 * | 4/2013 | Geiberger | 222/153.03 |

FOREIGN PATENT DOCUMENTS

| | | | | |
|---|---|---|---|---|
| CH | 393651 | A | 6/1965 | |
| DE | 202010002163 | U1 | 4/2010 | |
| DE | 102009049261 | A1 * | 5/2011 | 222/181.3 |

(Continued)

*Primary Examiner* — Lien Ngo

(74) *Attorney, Agent, or Firm* — Volpe and Koenig, P.C.

(57) ABSTRACT

A wall-mounted metering dispenser for liquids, comprising a wall mounting element, on which a reservoir is detachably mounted, which can be actuated by applying compressive force to the reservoir wall. The reservoir and removal device form an exchangeable refilling unit, detachably connectable to the wall mounting element at two fastening points, the first fastening point is a connecting element detachably mounted on the wall mounting element and the second fastening point engages at the end face area of the reservoir facing away from the connecting element such that the refilling unit is secured against forces acting in the longitudinal and transverse directions. The second fastening point has a fastening hook. In the mounted position of the refilling unit, the fastening hook is inserted into a depression on the end face area of the reservoir facing away from the connecting element so the refilling unit is secured against swiveling.

4 Claims, 4 Drawing Sheets

(56) References Cited

FOREIGN PATENT DOCUMENTS

| | | | | | |
|---|---|---|---|---|---|
| DE | 202010009176 | U1 * | 2/2012 | ..... | 222/153.03 |
| EP | 0530789 | B1 | 3/1993 | | |
| EP | 2225988 | A1 | 9/2010 | | |
| GB | 800544 | A | 8/1958 | | |
| WO | 0018282 | A1 | 4/2000 | | |
| WO | 2011045035 | A1 | 4/2011 | | |
| WO | WO-2011/157308 | A1 * | 12/2011 | ..... | 222/153.03 |

* cited by examiner

WALL-MOUNTED METERING DISPENSER

BACKGROUND

The invention relates to a wall-mounted metering dispenser for liquid soap, hair shampoo or similar liquids, having a wall holder on which there is releasably retained a storage container which consists of an elastic material, is exposed and can be subjected to pressure at least in a compliant sub-region of its container wall, and from which the liquid is removable via a removal device which is openable or actuable by pressure activation of the container wall, wherein the storage container and the removal device form an exchangeable refill unit which has two spaced-apart fastening points, wherein the refill unit is releasably connectable to the wall holder at these two spaced-apart fastening points, of which a first fastening point is in the form of a connecting element retained releasably on the wall holder, and of which a second fastening point acts in such a way on that end face region of the storage container that is remote from the connecting element that the refill unit is mountable on the wall holder, between the fastening points, in a manner secured against forces that act in the longitudinal and transverse directions of the wall-mounted metering dispenser, wherein the second fastening point has a fastening hook that projects beyond the wall holder, the fastening hook, in the retained position of the refill unit, is inserted in such a way into an appropriately shaped depression, which is provided at least on that end face region of the storage container that is remote from the connecting element, that the refill unit is also secured against pivoting about its longitudinal axis, and wherein the connecting element which serves as the first fastening point and is releasably retained on the wall holder is secured thereon by means of an anti-theft device, which has at least one latching hook that projects from the connecting element, the free latching hook end of which is releasably latchable into a latching hook catch in the wall holder such that a latching hook projection engages behind an undercut provided on the latching hook catch and which is movable or deflectable from a locked or latched position, counter to the inherent elasticity, that serves as a restoring force, of the hook material, into a released or unlocked position by means of a releasing tool that is introducible into the anti-theft device.

DE 20 2010 002 163 U1 already discloses a wall-mounted metering dispenser of the type mentioned in the introduction, which has a wall holder on which there is releasably retained a storage container which consists of an elastic material. From the storage container, which is retained with its compliant container wall exposed, the liquid is removable via a removal device which is openable or actuable by pressure activation of the container wall. In this case, the storage container and the removal device form an exchangeable refill unit which is releasably connectable to the wall holder at two spaced-apart fastening points. A first fastening point is configured as an annular connecting element which is releasably retained on the wall holder and accommodates the bottle neck of the storage container. A second fastening point acts in such a way on that end face region of the storage container that is remote from the connecting element that the refill unit is mountable on the wall holder, between the fastening points, in a manner secured against forces that act in the longitudinal and transverse directions of the wall-mounted metering dispenser. In order to be able to remove the refill unit, retained securely and firmly between these fastening points, from the wall holder, a latching hook is provided on the annular sub-region of the first connecting element, said latching hook being releasably latchable on the wall holder such that, by releasing or latching the connecting element that engages around the bottle neck of the storage container, the refill unit of the previously known wall-mounted metering dispenser can be removed from the wall holder or can be secured thereon. The second fastening point has a fastening hook which projects beyond the wall holder and, in the retained position of the refill unit, is inserted in such a way into an appropriately shaped depression, which extends in a circumferential manner at least on that end face region of the storage container that is remote from the first fastening point, that the refill unit is also secured against pivoting about its longitudinal axis.

Since the wall-mounted metering dispenser previously known from DE 20 2010 002 163 U1 has a separate connecting element which serves as a first fastening point and the annular sub-region of which is intended to engage around the storage container in the region of its bottle neck, the production of this previously known wall-mounted metering dispenser is associated with relatively large outlay and it can also be relatively difficult to exchange the refill units and thus to handle this wall-mounted metering dispenser.

U.S. Pat. No. 3,096,913 A already discloses a toothpaste dispenser which is likewise mountable on the wall and has a storage bottle the neck of which opens into a metering device. This metering device has a rotatably mounted cellular wheel, in the cells of which some of the toothpaste can collect. By pulling a toothbrush introduced into the housing of the previously known toothpaste dispenser past the cellular wheel, the bristle arrangement of the toothbrush is coated with toothpaste and at the same time the cellular wheel is rotated further by one cell into the removal position. No provision is made for pressure activation of the storage container in the toothpaste dispenser previously known from U.S. Pat. No. 3,096,913 A. Furthermore, the previously known toothpaste dispenser is neither suitable nor provided for generally accessible use, for example in a hotel room.

EP 0 530 789 B1 already discloses a wall-mounted metering dispenser having a wall holder on which there is releasably retained a storage container which consists of an elastic material and is exposed and can be subjected to pressure at least in a compliant sub-region of its container wall. From the storage container, in which liquid soap, hair shampoo or similar liquids can be stored, the liquid is removable via a removal device which is openable or actuable by pressure activation of the container wall. In this case, the storage container and the removal device form an exchangeable refill unit which is releasably connectable to the wall holder at two spaced-apart fastening points. Of these fastening points, a first fastening point is in the form of a connecting element which engages around certain regions of the refill unit, is configured as a retaining sleeve and is retained releasably on the wall holder, while the second fastening point acts in such a way on that end face region of the storage container that is remote from the connecting element that the refill unit is mountable on the wall holder, between the fastening points, in a manner secured against forces that act in the longitudinal and transverse directions of the wall-mounted metering dispenser.

In order to be able to mount the refill unit of the previously known wall-mounted metering dispenser in a rotationally fixed manner in the wall holder, the storage bottle has a non-round and in particular an elliptical cross section, with the second fastening point being in the form of a hollow body that surrounds in a hat-like or pot-like manner the end face region, which is likewise non-round in cross section, of the storage bottle. However, the non-round shape of the storage bottle limits the possible configurations, with the hat-like or pot-like second fastening point that is adapted to this non-round shape of the storage bottle requiring corresponding dimensioning of the wall holder, too.

SUMMARY

It is, therefore, the object of the invention, in particular, to create a wall-mounted metering dispenser of the type mentioned in the introduction, which is distinguished by a compact and esthetically pleasing shape and provides a greater scope of variation in possible configurations.

In the case of the wall-mounted metering dispenser of the type mentioned in the introduction, this object is achieved according to the invention in particular in that the second fastening point has a fastening hook that projects beyond the wall holder, and in that the fastening hook, in the retained position of the refill unit, is inserted in such a way into an appropriately shaped depression, which is provided at least on that end face region of the storage container that is remote from the connecting element, that the refill unit is also secured against pivoting about its longitudinal axis.

In the wall-mounted metering dispenser according to the invention, the second fastening point is configured as a fastening hook which projects beyond the wall holder. This fastening hook is inserted, in the retained position of the refill unit, in a depression which is provided at least on that end face region of the storage container that is remote from the connecting element. The fastening hook is inserted into the appropriately shaped depression in such a way that the refill unit is also secured against pivoting about its longitudinal axis. Since the fastening hook acts on the storage container in the region of the depression, axial movement of the refill unit in the retained position is not readily possible; since the fastening hook is inserted into the appropriately shaped depression, a pivoting movement of the storage container about its longitudinal axis is also prevented. Therefore, the refill unit is retained securely and firmly in the retained position on the wall holder and can be easily removed therefrom and for example exchanged only by releasing the first fastening point. Since the storage container does not necessarily have to have a non-round cross section, the wall-mounted metering dispenser according to the invention is distinguished by a large number of possible configurations. The appropriately shaped design of the fastening hook and the storage container also represents tamperproof securing which prevents unauthorized installation of different bottles.

A development according to the invention, in which a secure hold between the refill unit on the one hand and the wall holder on the other hand is additionally supported, provides that the depression has at least one first depression section provided on that end face region of the storage container that is remote from the connecting element, and a second depression section arranged on the circumferential wall of the storage container.

In this case, a structurally simple embodiment according to the invention, which is producible with little effort, provides that the first and the second depression sections merge into one another via the peripheral region surrounding the end face region of the storage container.

Unauthorized manipulations of the refill unit located in the wall-mounted metering dispenser according to the invention and of the liquid stored in the storage container are prevented when the connecting element releasably retained on the wall holder is secured thereon by means of an anti-theft device. Thus, it is only possible to release the refill unit fastened to the wall holder when the anti-theft device is opened by way of an appropriate releasing tool.

A preferred embodiment according to the invention provides that the anti-theft device has at least one latching hook that projects from the connecting element or from the wall holder, and that the latching hook is movable or deflectable from a locked or latched position, counter to the inherent elasticity, that serves as a restoring force, of the hook material, into a released or unlocked position by means of a releasing tool that is introducible into the anti-theft device.

A preferred embodiment according to the invention provides that the at least one latching hook projects from the connecting element and its free latching hook end is releasably latchable into a latching opening in the wall holder such that a latching hook projection engages behind an undercut (35) provided on the latching hook catch (34).

A particularly esthetically pleasing embodiment according to the invention provides that the wall holder has a fastening plate, and/or that the storage container has a substantially cylindrical circumferential wall.

The effort associated with the construction and production of the wall-mounted metering dispenser according to the invention is eased and a firm hold of the refill unit on the wall holder is supported when the connecting element is configured, at least in a sub-region, as a closure cap assigned to the storage container or as a retaining sleeve that engages around certain regions of the refill unit in particular in the region of a closure cap.

BRIEF DESCRIPTION OF THE DRAWINGS

Further features of the invention can be gathered from the following description of an exemplary embodiment according to the invention in conjunction with the claims and the drawing. The individual features may be realized on their own or in combination in any embodiment according to the invention.

In the drawing.

DETAILED DESCRIPTION OF THE PREFERRED EMBODIMENTS

Figure 1:
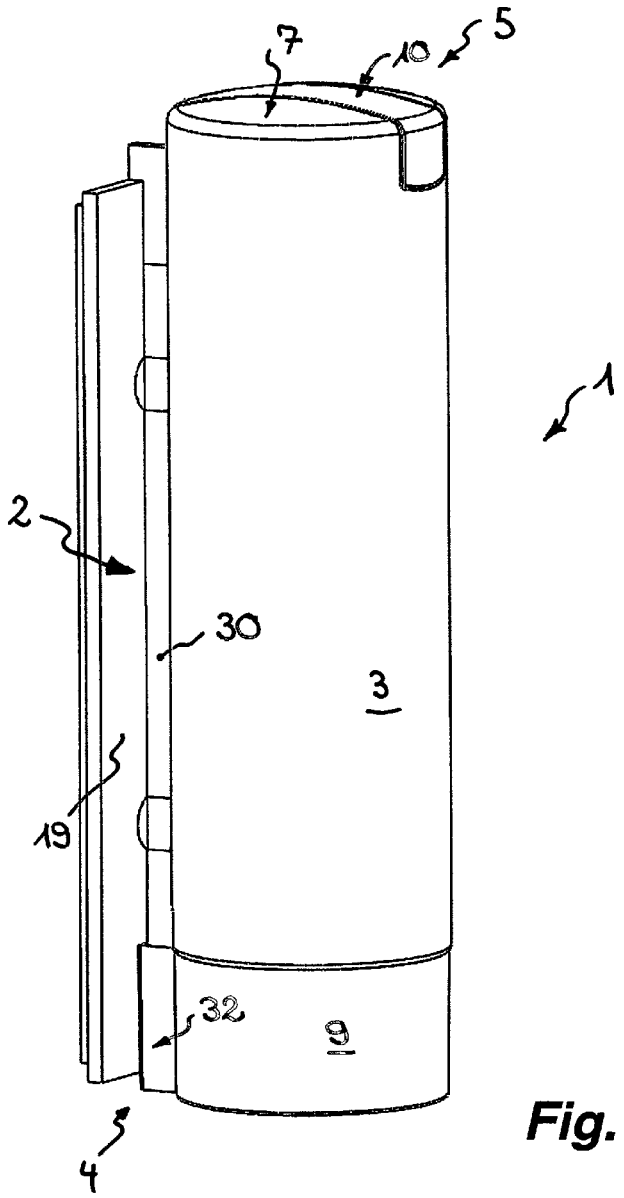
FIG. 1 shows a perspective illustration of a wall-mounted metering dispenser in which an exchangeable refill unit is releasably fastenable to a wall holder.

FIGS. 1 to 4 illustrate a wall-mounted metering dispenser 1 for liquid soap, hair shampoo or similar liquids. The wall-mounted metering dispenser 1 has a wall holder 2, on which a storage container 3 that consists of an elastic material is releasably retained. The storage container 3 is intended to be fastened to the wall holder 2 in such a manner as to be exposed and able to be subjected to pressure in the region of its circumferential wall. The liquid stored in the storage container 3 is removable via a removal device (not shown in more detail here), which is openable or actuable by manual pressure activation of the circumferential wall. The storage container 3 and the removal device form an exchangeable refill unit, which is releasably connectable to the wall holder 2 at two spaced-apart fastening points 4, 5. While a first fastening point 4 is in the form of a connecting element 6 which is configured, at least in a sub-region 9, as a closure cap assigned to the storage container 3 and releasably retained on the wall holder 2, a second fastening point 5 acts in such a way on that end face region 7 of the storage container 3 that is remote from the connecting element 6 that the refill unit is mountable on the wall holder 2, between the fastening points 4, 5, in a manner secured against forces that act in the longitudinal and transverse directions of the wall-mounted metering dispenser 1.

It is clear from FIG. 1 that the container opening surrounded by a bottle or container neck 8 is closable by means of the sub-region 9, in the form of a closure cap, of the connecting element 6, wherein the removal opening, which is directed downwardly in the use position, of the refill unit is integrated into the sub-region 9, in the form of a closure cap, of the connecting element 6.

Figure 2:
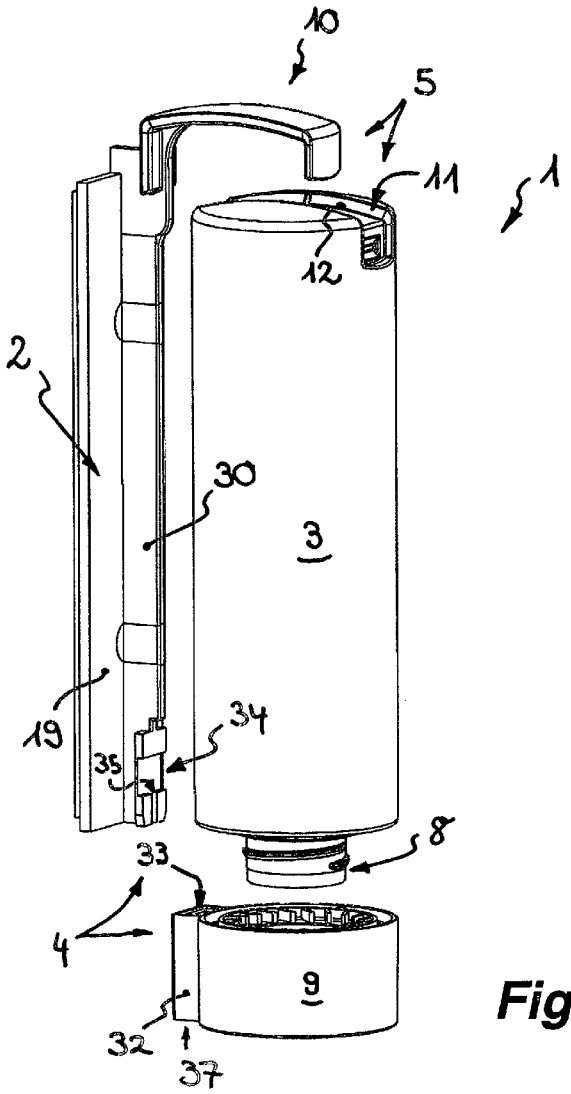
FIG. 2 shows a perspective front view of the refill unit, separated from the wall holder, of the wall-mounted metering dispenser from FIG. 1.
Figure 3:
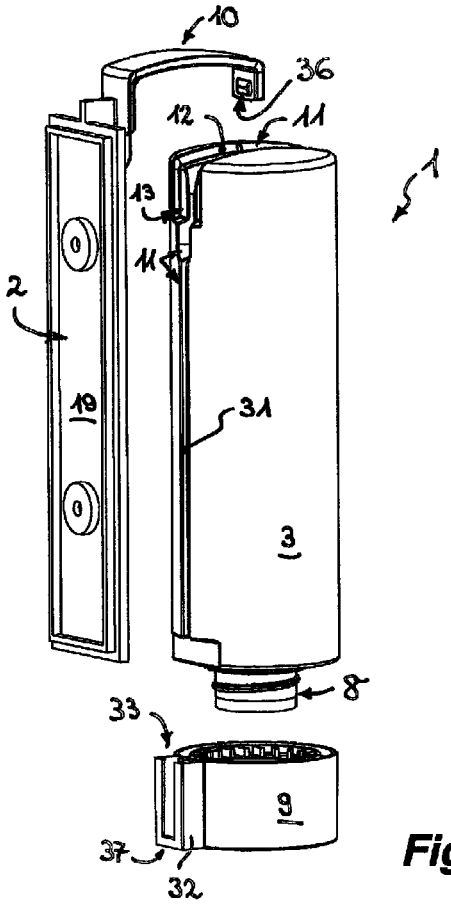
FIG. 3 shows a perspective rear view of the refill unit, separated from the wall holder, of the wall-mounted metering dispenser from FIGS. 1 and 2.

It can be seen in FIGS. 1 to 3 that the second fastening point 5 has a fastening hook 10 that projects beyond the wall holder 2. In the retained position of the refill unit, the fastening hook 10 is inserted in such a way into an appropriately shaped depression 11, which is provided at least on that end face region of the storage container 3 that is remote from the retaining sleeve 6, that the refill unit is also secured against pivoting about its longitudinal axis.

The fastening hook 10 is inserted into the appropriately shaped depression 11 in such a way that the refill unit is also secured against pivoting about its longitudinal axis. Since the fastening hook 10 acts on the storage container 3 in the region of the depression 11, axial movement of the refill unit in the retained position is not readily possible; since the fastening hook 10 is inserted into the appropriately shaped depression 11, a pivoting movement of the storage container 3 about its longitudinal axis is also not possible. Therefore, the refill unit is retained securely and firmly in the retained position on the wall holder 2 and can be easily removed therefrom and for example exchanged only by releasing the first fastening point 4. The appropriately shaped configuration of the fastening hook 10 and the depression 11 provided on the storage container 3 also represents tamperproof securing which prevents unauthorized installation of a different storage container.

Provided on the free end region of the fastening hook 10 is a latching protrusion 36 which projects in the direction of the storage container 3 and passes into an appropriately shaped depression in the storage container 3 in the use position. By means of this latching protrusion 36, a secure hold is ensured even in the event of fluctuations in size as could be produced by production-related shrinkage of the container.

It can be seen in FIG. 3 that the depression 11 has at least one first depression section 12 provided on that end face region of the storage container 3 that is remote from the connecting element 6, and a second depression section 13 arranged on the circumferential wall of the storage container 3. In this case, the first and the second depression sections 12, 13 merge into one another via the peripheral region surrounding the end face region of the storage container 3. Here, the fastening hook 10, which is formed in an approximately L-shaped manner, is integrally formed in the form of a rib on the wall holder 3 and engages in the depression sections 12, 13 of the depression 11. The fastening hook 10 has a sub-region 30 which is oriented in the longitudinal direction, projects by way of its narrow side, and engages, preferably in a form-fitting manner, in a circumferentially provided, groove-like sub-region, oriented in the longitudinal direction, of the depression section 13 provided on the storage container 3.

Figure 4:
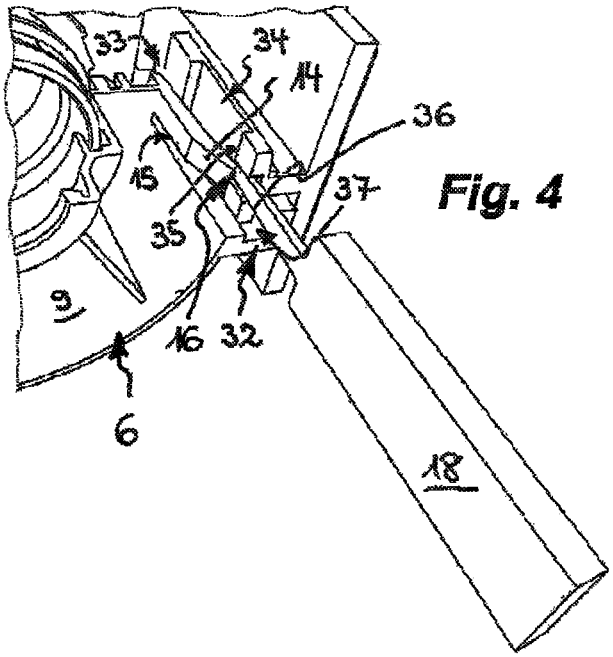
FIG. 4 shows a detail view of the wall-mounted metering dispenser from FIGS. 1 to 3 in the region of a lower first fastening point between the refill unit and the wall holder.

The connecting element 6 releasably retained on the wall holder 2 is secured thereon by means of an anti-theft device, which is illustrated in more detail in the detail view in FIG. 4. A receiving sleeve 32 which is open at the end side and toward the wall holder is integrally formed on the sub-region 9, configured as a closure cap, of the connecting element 6. A latching hook catch 34, which is retained in a spaced-apart manner on the wall holder 2 and is in the form of a plate here, can be pushed into the introduction opening 33 provided on the end side of the receiving sleeve 32. A latching hook 14 projects into the interior of the receiving sleeve 32, said latching hook 14 being in the form of a rib-like wall section that is freed by incisions 15 on both sides of the circumferential wall of the sub-region 9, configured as a closure cap, of the connecting element 6, and being movable from a locked or latched position, counter to the inherent elasticity, that serves as a restoring force, of the material used for the connecting element 6, into a released or unlocked position. In the locked position, the latching hook engages, by way of a latching hook projection 16 provided on the free latching hook end, behind an undercut 35 provided on the latching hook catch 34, in such a way that the connecting element 6 and the refill unit connected thereto are retained on the wall holder 2 in a manner secured against unauthorized manipulations.

The rib-like releasing protrusion 36 of a releasing tool 18 can be pushed through the end-side opening 37 in the receiving sleeve 32 and into the region located between the wall holder 2 and the free latching hook end, in such a way that the latching hook 14 is deflectable and movable into the released position. In this released position, in which the latching hook 14 no longer engages behind the undercut 35 on the hook catch 34, the connecting element 6 can be removed, together with the refill unit, from the wall holder 2 and for example for another refill unit. By pushing the refill unit into the use position located on the wall holder 2, the latching hook catch 34 is also pushed into the receiving sleeve 32 until the latching hook 14, 15 deflects by way of its latching hook projection 16 into its securing position.

It can be seen in FIGS. 1 to 3 that the wall holder 2 has a thin rectangular fastening plate 19 and that the bottle-like storage container 3 has a substantially cylindrical circumferential wall. Furthermore, it can be seen in FIGS. 1 to 3 that connecting element 6 is configured, at least in a sub-region, as a closure cap that can close the container opening and can be screwed onto the container neck. In this case, it is advantageous for the connecting element 6 to be produced, at least in its sub-region 9 configured as a closure cap, from transparent or see-through plastics material so that the remaining quantity of the liquid located in the storage container 3 is visible in the region of the removal opening integrated into the closure cap 9.

What is claimed is:

1. A wall-mounted metering dispenser (1) for liquids, comprising a wall holder (2) on which there is releasably retained a storage container (3) formed of an elastic material, that is exposed and can be subjected to pressure at least in a compliant sub-region of a container wall thereof, and from which the liquid is removable via a removal device which is openable or actuable by pressure activation of the container wall, the storage container (3) and the removal device form an exchangeable refill unit which has first and second spaced-apart fastening points (4, 5), the refill unit is releasably connectable to the wall holder (2) at the two spaced-apart fastening points (4, 5), of which the first fastening point (4) is a connecting element (6) that is retained releasably on the wall holder, and the second fastening point acts on an end face region (7) of the storage container (3) that is remote from the connecting element (6) so that the refill unit is mountable on the wall holder (2), between the fastening points (4, 5), in a manner secured against forces that act in longitudinal and transverse directions of the wall-mounted metering dispenser (1), the second fastening point (5) has a fastening hook (10) that projects beyond the wall holder (2), the fastening hook (10), in the retained position of the refill unit, is inserted in an appropriately shaped depression (11), which is provided at least on the end face region (7) of the storage container (3) that is remote from the connecting element (6), so that the refill unit is also secured against pivoting about its longitudinal axis, and the connecting element (6) which serves as the first fastening point and is releasably retained on the wall holder (2) is secured therein by an anti-theft device, which has at least one latching hook (14) that projects from the connecting element (6), a free latching hook end of the latching hook (14) is releasably latchable into a latching hook catch (34) in the wall holder (2) such that a latching hook projection (16) engages behind an undercut (35) provided on the latching hook catch (34) and the latching hook (14) is movable or deflectable from a locked or latched position, counter to an inherent elasticity, that serves as a restoring force, of the hook material, into a released or unlocked position by a releasing tool (18) that is introducible into the anti-theft device, the connecting element is configured, at least in a sub-region (9), as a closure cap which is assigned to the storage container and acts on the refill unit in a region of a container neck or bottle neck (3), and the depression (11) has at least one first depression section (12) provided on the end face region of the storage container (3) that is remote from the retaining sleeve (6), and a second depression section (13) arranged on a circumferential wall of the storage container (3).

2. The wall-mounted metering dispenser as claimed in claim 1, wherein the first and the second depression sections (12, 13) merge into one another via a peripheral region surrounding the end face region (7) of the storage container (3).

3. The wall-mounted metering dispenser as claimed in claim 1, wherein the wall holder (2) has a fastening plate (19).

4. The wall-mounted metering dispenser as claimed in claim 1, wherein the storage container (3) has a substantially cylindrical circumferential wall.

* * * * *